US006773228B2

(12) United States Patent
Rainous et al.

(10) Patent No.: US 6,773,228 B2
(45) Date of Patent: Aug. 10, 2004

(54) METHODS AND APPARATUS FOR TURBINE NOZZLE LOCKS

(75) Inventors: Edward Atwood Rainous, Cincinnati, OH (US); Charles Louis Williams, Loveland, OH (US); Michael Peter Murphy, Loveland, OH (US); Janice Ilene Pirtle, Milford, OH (US); James Harold Joy, Batavia, OH (US)

(73) Assignee: General Electric Company, Schenectady, NY (US)

( * ) Notice: Subject to any disclaimer, the term of this patent is extended or adjusted under 35 U.S.C. 154(b) by 129 days.

(21) Appl. No.: 10/188,438

(22) Filed: Jul. 3, 2002

(65) Prior Publication Data

US 2004/0005217 A1 Jan. 8, 2004

(51) Int. Cl.[7] ..... F01D 9/04
(52) U.S. Cl. ..... 415/189; 415/209.3; 29/889.22
(58) Field of Search ..... 29/889.22; 415/189, 415/201, 202, 209.2, 209.3

(56) References Cited

U.S. PATENT DOCUMENTS

| | | | | | |
|---|---|---|---|---|---|
| 3,788,763 | A | * | 1/1974 | Nickles | 415/160 |
| 4,245,951 | A | * | 1/1981 | Minnich | 415/209.4 |
| 4,957,412 | A | * | 9/1990 | Olson et al. | 415/189 |
| 5,618,161 | A | * | 4/1997 | Papageorgiou et al. | 415/209.3 |
| 6,537,022 | B1 | * | 3/2003 | Housley et al. | 415/189 |

FOREIGN PATENT DOCUMENTS

JP 52067806 A * 6/1977 ..... F04D/29/34

* cited by examiner

*Primary Examiner*—Edward K. Look
*Assistant Examiner*—Richard Edgar
(74) *Attorney, Agent, or Firm*—William Scott Andes; Armstrong Teasdale LLP; Robert Reeser, III

(57) ABSTRACT

A method enables a gas turbine engine nozzle to be secured within an engine casing that includes an exterior surface. The method comprises the steps of forming a first opening to extend through the engine casing, inserting a nozzle lock through the first opening from the casing exterior surface, coupling the nozzle lock to a portion of the nozzle, and securing the nozzle lock to the engine casing.

20 Claims, 6 Drawing Sheets

METHODS AND APPARATUS FOR TURBINE NOZZLE LOCKS

BACKGROUND OF THE INVENTION

This application relates generally to gas turbine engines and, more particularly, to nozzle locks for gas turbine engines.

Gas turbine engines typically include a compressor, a combustor, at least one turbine nozzle and a rotor assembly serially connected in flow communication. An engine casing extends around the engine from the compressor to the turbine assembly.

In operation, airflow exiting the compressor is mixed with fuel and ignited within the combustor, and the resulting hot gas/air mixture is channeled through the turbine nozzles to the rotor assembly. As a result of exposure to the hot gas/air mixture, pressure loading may develop within the turbine nozzles.

To facilitate reducing the effects of pressure loading to the turbine nozzle, at least some known turbine engines include a plurality of internal nozzle locks to maintain the turbine nozzles in alignment. The nozzle locks secure the turbine nozzle within the casing to facilitate retaining the nozzles in circumferential alignment. Accordingly, to install or replace the nozzle locks, the turbine casing is first removed. Such a procedure is time-consuming and costly.

BRIEF SUMMARY OF THE INVENTION

In an exemplary embodiment, a plurality of externally attachable nozzle locks for a gas turbine engine secure turbine nozzles within the engine in a cost-effective and reliable manner. Each nozzle lock includes a base, an attachment device coupled to the base, and a locking pin that extends from the base. More specifically, the locking pins extend from a respective base through the turbine casing to secure the nozzles within the turbine casing.

During assembly of each nozzle lock to the gas turbine engine an opening in the turbine casing is formed, extending through the turbine casing radially outwardly from the turbine nozzle. The nozzle lock is inserted through the opening from an exterior surface of the engine casing and coupled to a portion of the nozzle. The nozzle lock is also secured to the engine casing. More specifically, the nozzle lock facilitates maintaining an alignment of the turbine nozzle despite being subjected to tangential forces induced on the turbine nozzles during engine operation. As a result, the turbine nozzle lock facilitates securing the nozzle within the engine in a cost effective and reliable manner.

DETAILED DESCRIPTION OF THE INVENTION

Figure 1:
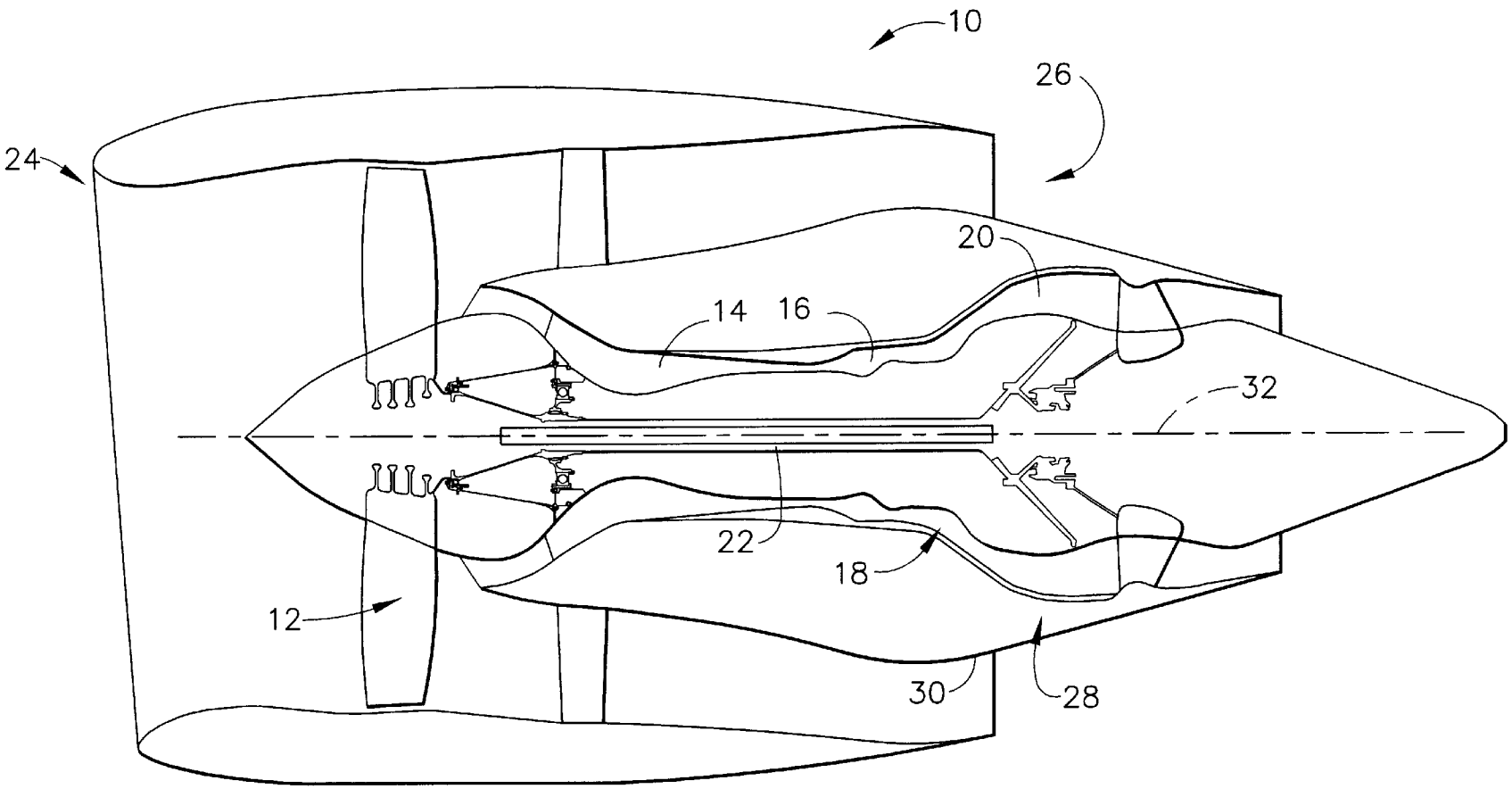
FIG. 1 is a schematic cross-sectional view of a gas turbine engine.

FIG. 1 is a schematic view of a gas turbine engine 10 including a fan assembly 12, a high-pressure compressor 14, and a combustor 16. Engine 10 also includes a high-pressure turbine 18 and a low-pressure turbine 20. A shaft 22 couples fan assembly 12 and turbine 20. Engine 10 has an intake side 24 and an exhaust side 26. An engine casing 28 including an exterior surface 30 extends circumferentially around engine 10. In one embodiment, gas turbine engine 10 is a GE90 engine commercially available from General Electric Company, Cincinnati, Ohio. Engine 10 also includes a center longitudinal axis of symmetry 32 extending therethrough.

In operation, air flows through fan assembly 12 and compressed air is supplied to high-pressure compressor 14. Highly compressed air is delivered to combustor 16 where it is mixed with fuel and ignited. Hot gas/air mixture from combustor 16 propels turbines 18 and 20, and turbine 20 rotates fan assembly 12 about axis 32.

Figure 2:
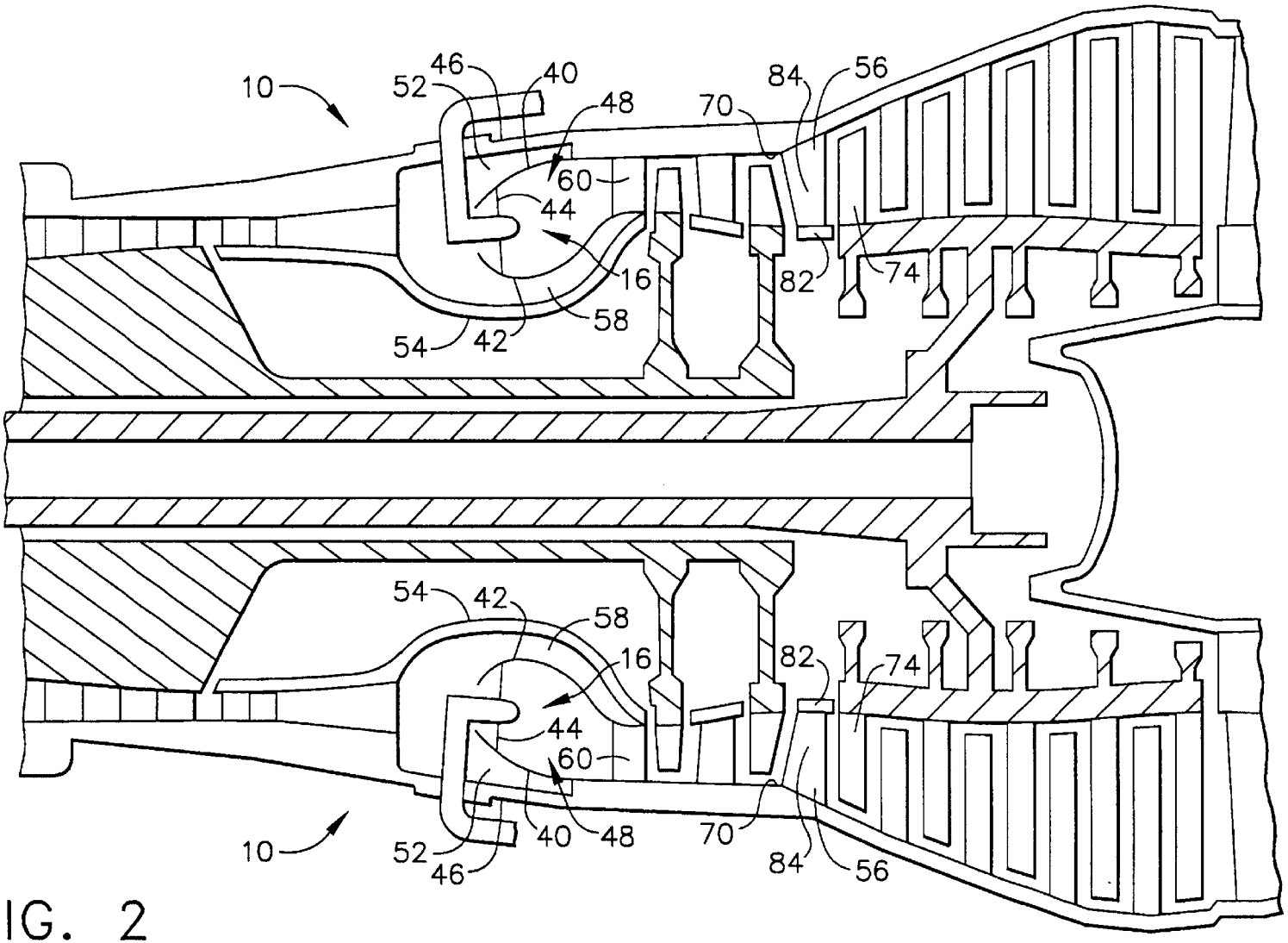
FIG. 2 is a partial cross-sectional view of a combustor used with the gas turbine engine shown in FIG. 1 and including a turbine nozzle and a turbine.

FIG. 2 is a partial cross-sectional view of combustor 16, including a turbine nozzle 56, of gas turbine engine 10 shown in FIG. 1. Combustor 16 includes an annular outer liner 40, an annular inner liner 42, and a domed end 44 extending between outer and inner liners 40 and 42, respectively. Outer liner 40 is spaced radially inward from a combustor casing 46 and couples to inner liner 42 to define a generally annular combustion chamber 48.

Combustor casing 46 is generally annular and extends downstream from a diffuser (not shown) positioned within domed end 44. Outer liner 40 and, combustor casing 46 define an outer passageway 52, and inner liner 42 and an inner combustor casing 54 define an inner passageway 58. Inner liner 42 is spaced radially outward from inner combustor casing 54. Outer and inner liners 40 and 42 extend to a turbine nozzle 60 disposed downstream from diffuser.

An annular turbine nozzle 56 is disposed radially inward from a casing internal wall 70. Combustor 16 is located upstream of nozzle 56, and turbine blades 74 are located downstream from nozzle 56. In one embodiment, engine 10 includes a plurality of nozzles 56.

Nozzle 56 includes an arcuate outer band 80 (shown in FIG. 4), an arcuate inner shroud segment 82, and a nozzle vane 84 mounted between outer band 80 and inner shroud segment 82. Nozzle vane 84 extends generally radially between outer band 80 and inner shroud segment 82.

Figure 3:
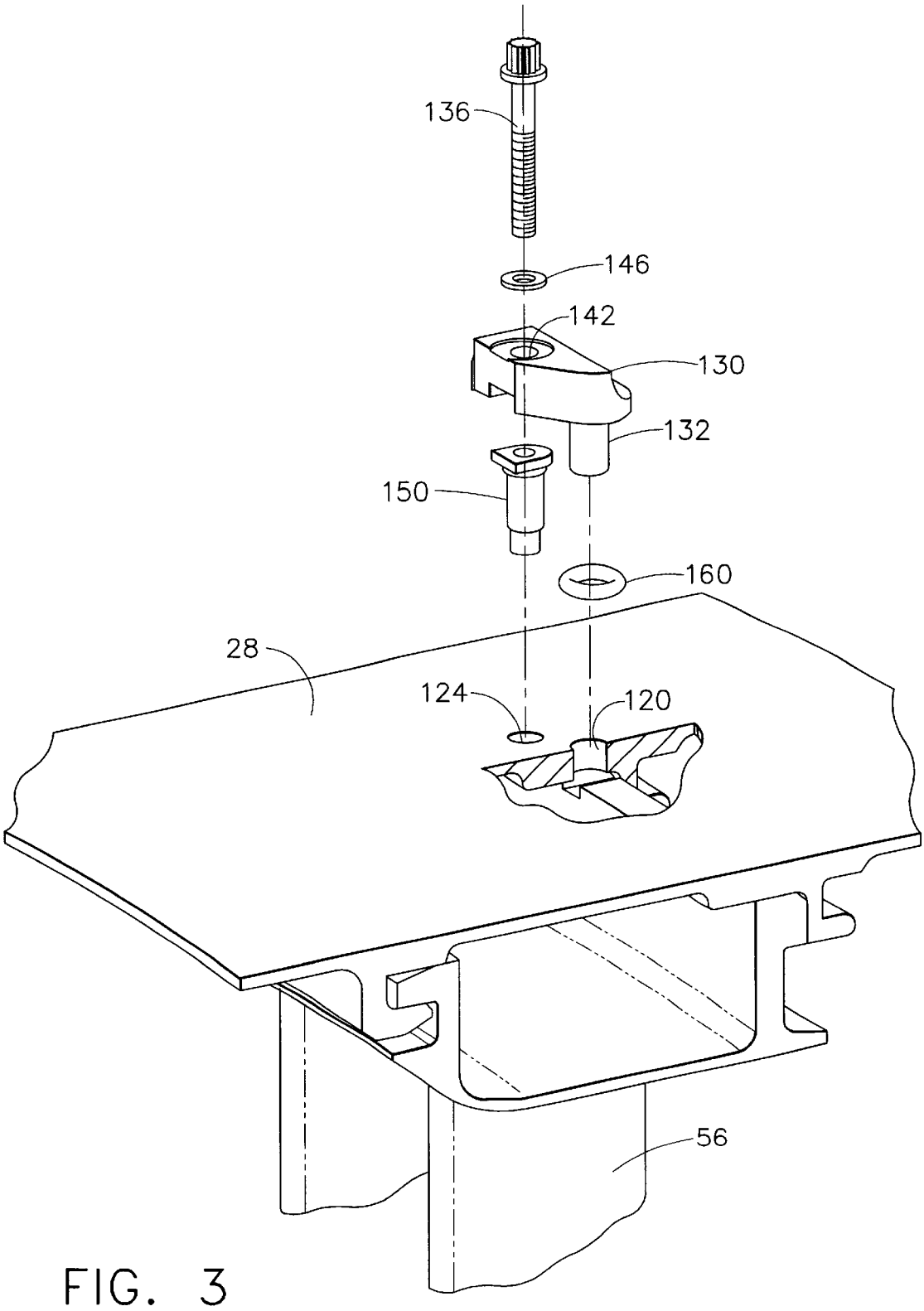
FIG. 3 is a three dimensional view of a gas turbine casing assembly including the turbine nozzle assembly shown in FIG. 2 and including an externally attachable nozzle lock assembly.
Figure 4:
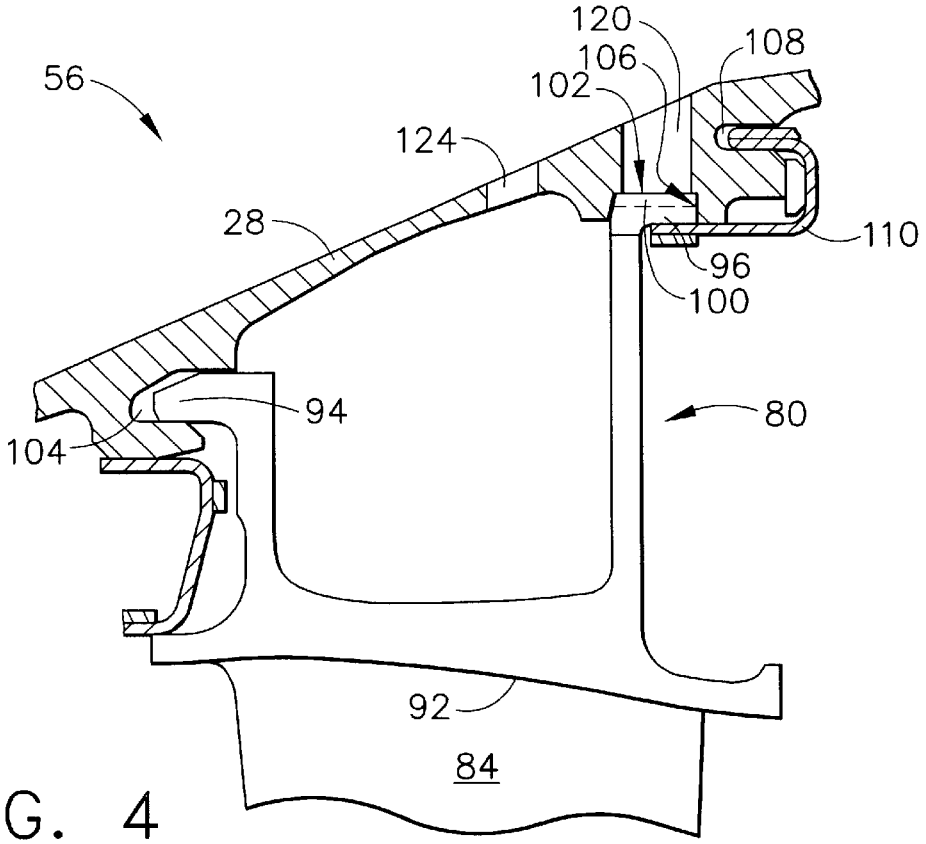
FIG. 4 is an enlarged view of the turbine nozzle shown in FIG. 2.
Figure 5:
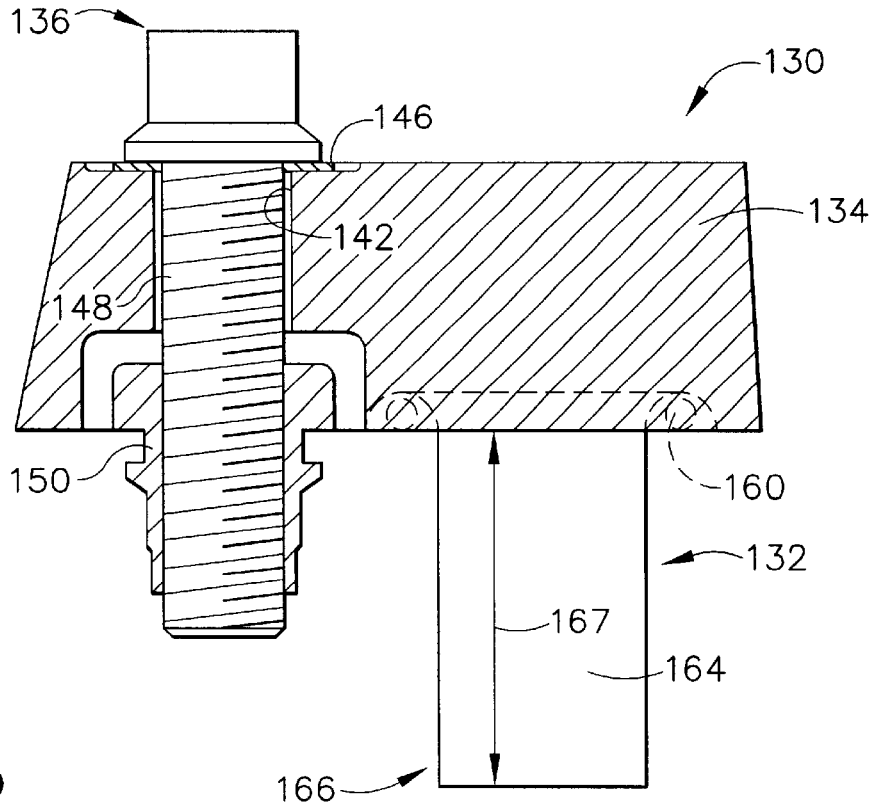
FIG. 5 is a side view of the turbine nozzle lock shown in FIG. 3.

FIG. 3 is a perspective view of gas turbine casing assembly 54 including turbine nozzle assembly 56. FIG. 4 is an enlarged view of turbine nozzle 56. FIG. 5 is a side view of a nozzle lock 130 used with turbine nozzle 56. Outer band 80 includes a generally axially extending platform 92 including an upstream circumferential forward support flange 94 and a downstream circumferential aft rail 96. Aft rail 96 includes a radial outer portion 102 including a slot 100 therein. Casing 28 includes a casing support channel 104, a casing shoulder 106, and a casing groove 108. A turbine shroud forward rail 110 extends between aft rail 96 and casing groove 108. In the exemplary embodiment, casing 28 also includes a first opening 120 and a second opening 124 that extend through casing 28. More specifically, first opening 120 is radially outward of slot 100, and a second opening 124 is adjacent and upstream from first opening 120. Forward support flange 94 engages casing support channel 104 to radially support outer band 80. Turbine shroud forward rail 110 radially supports aft rail 96 to casing shoulder 106 and facilitates minimizing leakage therebetween.

Nozzle lock 130 includes a locking pin 132, a base 134, and an attachment device 136. In one embodiment, locking pin 132 is formed unitarily with base 134. In a further embodiment base 134 includes a first aperture (not shown) sized to receive and fixedly retain locking pin 132. Base 134 includes a second aperture 142 for receiving attachment device 136. In one embodiment, attachment device 136 is a blind bolt 148 including an insert 150, and is inserted through a washer 146. In another embodiment attachment device 136 is a rivet (not shown). Nozzle lock 130 includes a seal 160. In one embodiment, seal 160 is a metallic O-ring seal.

Locking pin 132 includes a substantially cylindrical body 164 and a tip 166. Body 164 extends substantially perpendicularly from base 134 such that tip 166 is a distance 167 from base 134. In one embodiment nozzle lock 130 includes a plurality of locking pins 132.

Figure 6:
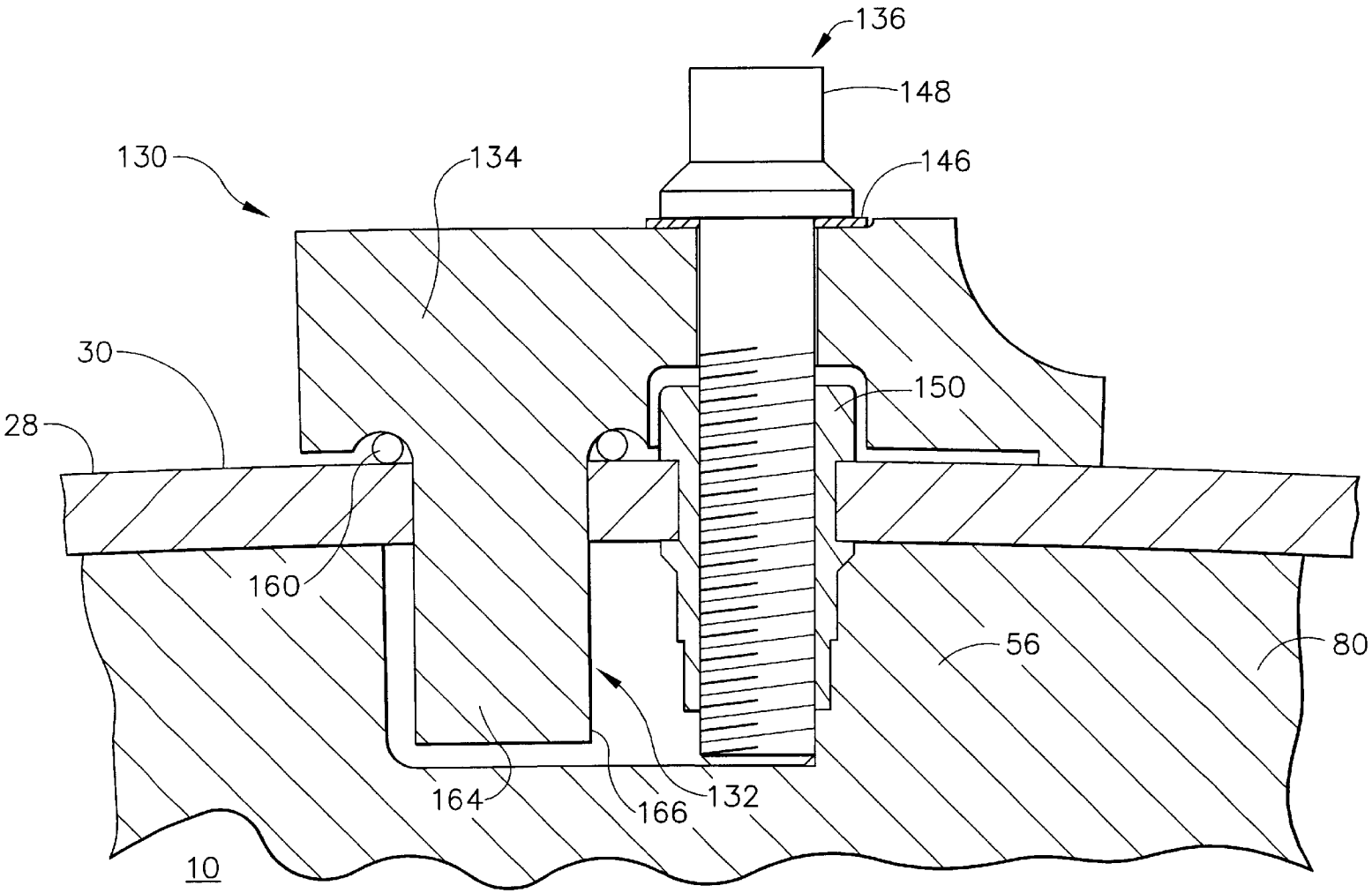
FIG. 6 is a cross-sectional view of the nozzle lock shown in FIG. 5 installed on a gas turbine engine.

FIG. 6 is a cross-sectional view of nozzle lock 130 coupled to gas turbine engine 10. Nozzle lock 130 facilitates restricting tangential movement of nozzle 56. Base 134 is coupled to exterior surface 30 by attachment device 136. Seal 160 extends circumferentially around locking pin 132 to facilitate reducing or eliminating gas/air mixture leakage through exterior surface 30.

Locking pin 132 extends through opening 120 (shown in FIG. 3) to radially engage aft rail slot 100 (shown in FIG. 3) to secure nozzle 56 to casing 28. Because nozzle 56 is secured to casing 28, nozzle lock 130 facilitates maintaining a relative alignment of nozzle 56 within engine 10 despite nozzle 56 being subjected to tangential forces induced by the gas/air mixture. Tip 166 is adapted to engage slot 100. In an exemplary embodiment tip 166 is cylindrical. In other embodiments a shape of tip 166 is selected to satisfy system requirements while securing nozzle 56 in slot 100, and includes, but is not limited to a square shape, a rectangular shape, or a crescent moon shape.

Attachment device 136 is coupled to base 134 and secures base 134 to casing 28. Attachment device 136 is inserted in second opening 124 (shown in FIG. 3) to secure base 134 to casing 28. In an alternate embodiment attachment device 136 includes a circumferential split ring (not shown) that encircles turbine engine 10 and secures base 134 to casing 28.

During operation hot gas/air mixture from combustor 16 (shown in FIG. 1) is directed through nozzle 56 to turbine blades 74 (shown in FIG. 2) to rotate the turbine rotor (not shown). The combustion gas mixture may exert axial and tangential forces on nozzle 56 as nozzle 56 redirects the gas/air mixture. Nozzle vane 84 (shown in FIG. 2) redirects the gas/air mixture to impinge on turbine blade 74 and impart a tangential force on nozzle 56. Outer band 80 and inner shroud segment 82 (shown in FIG. 2) support and position nozzle vane 84. Nozzle lock 130 secures outer band 80 to casing 28 and restrains tangential movement or flexing of nozzle 56. Base 134 is mounted to casing external surface 30 and seal 160 seals casing 28.

In one embodiment, nozzle lock 130 is installed during initial assembly. In an alternate embodiment, nozzle lock 130 is installed as an engine maintenance procedure after engine assembly. In a further embodiment, nozzle lock 130 supplements internal nozzle locks already installed on an engine, and as such, nozzle lock 130 is capable of being installed with or without a removal of other engine components. Advantageously, nozzle lock 130 can be installed on an engine without disassembly of engine casing 28 or removal of engine 10 from its operating configuration, such as on an aircraft wing.

In one embodiment a technician forms opening 120 in casing by drilling using standard machining techniques to maintain gas turbine cleanliness. The technician inserts locking pin 132 of nozzle lock 130 from casing exterior surface 28 through opening 120 to engage a portion of nozzle 56. In one embodiment tip 166 engages slot 100 to secure nozzle 56 and restrict tangential movement of nozzle 56. The technician secures nozzle lock 130 to engine casing 28. In one embodiment the technician inserts bolt 148 through second aperture 142 (shown in FIG. 3) and into second opening 124 to secure nozzle lock 130 to casing exterior surface 28.

Figure 7:
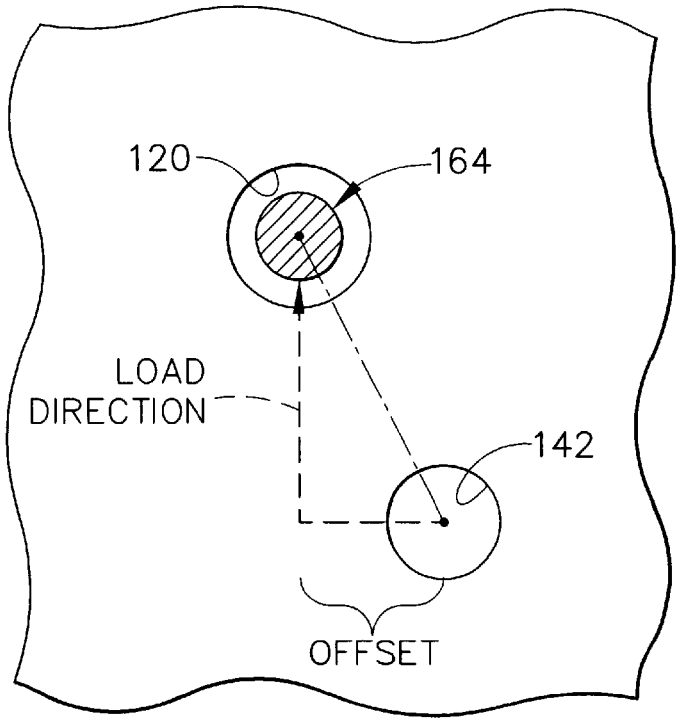
FIG. 7 illustrates an exemplary first loading relationship between the nozzle lock shown in FIG. 5 and an attachment opening extending through the gas turbine casing shown in FIG. 3.
Figure 8:
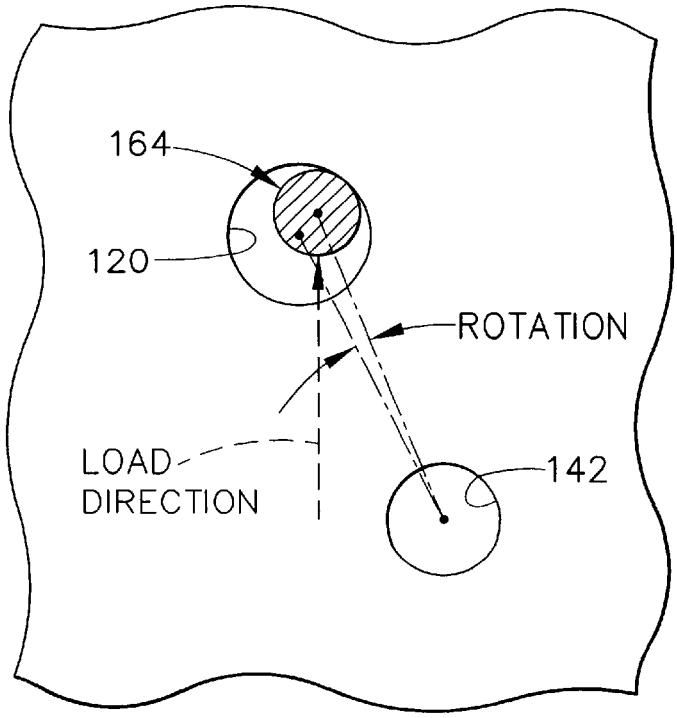
FIG. 8 illustrates an exemplary second loading relationship between the nozzle lock and the attachment opening shown in FIG. 7.

FIG. 7 illustrates a first loading relationship between nozzle lock 164 and engine casing opening 120 with respect to attachment aperture 142. FIG. 8 illustrates a second loading relationship between nozzle lock 164 and engine casing opening 120 with respect to attachment aperture 142. In the exemplary embodiment of FIG. 7, a load applied to nozzle lock body 164 adjacent to nozzle outer band 80 (shown in FIG. 4) may result in unacceptably high stresses in nozzle lock 130, if nozzle lock cylindrical body 164 is not in direct contact with case opening 120. More specifically, fatigue failure of nozzle lock 130may result from such loading. However, if nozzle lock cylindrical body 164 is in contact with case opening 120 stresses induced to nozzle lock 130 are facilitated to be reduced. Unfortunately, due to necessary manufacturing tolerances, the above-described contact may not always be guaranteed.

In the exemplary embodiment of FIG. 8, a single attachment aperture 142 is formed in engine casing 28 with a position offset from the direction of load application. The resulting moment about aperture 142 may result in a slight physical rotation of nozzle lock assembly 130 until contact is made between nozzle lock cylindrical body 164 and case opening 120, as shown in FIG. 8. This type of stress reducing, self-adjusting capability is possible because of two conditions that are present in this invention. More specifically, a first condition is that the attachment is statically unstable once clamping friction at aperture 142 is exceeded. The second such condition is that relative position of aperture 142 is not along a line of action of load application, thus resulting in a moment about aperture 142 and subsequent rotation.

The above-described nozzle lock for a gas turbine engine is cost-effective and reliable. The nozzle lock secures the nozzle to the casing, thus facilitating maintaining the nozzles in alignment within the engine. Furthermore, because the nozzles are secured in alignment, the nozzle lock also facilitates reducing the effects of tangential forces induced to the nozzles during engine operation. In addition, because the nozzle lock may be installed or removed from the engine without removing the engine casing, the nozzle lock also facilitates in-place engine maintenance. Furthermore, the nozzle locks facilitate the nozzles self-aligning with respect to the load path during operation. As a result, the nozzle lock facilitates maintaining the nozzle in alignment in a cost-effective and reliable manner.

While the invention has been described in terms of various specific embodiments, those skilled in the art will recognize that the invention can be practiced with modification within the spirit and scope of the claims.

What is claimed is:

1. A method for securing a gas turbine engine nozzle within an engine casing that includes an exterior surface, said method comprising the steps of:

forming a first opening to extend through the engine casing;

inserting a nozzle lock through the first opening from the casing exterior surface, wherein the first opening is formed such that the portion of the nozzle lock inserted therethrough is offset from a direction of load application induced to the nozzle lock during engine operation;

coupling the nozzle lock to a portion of the nozzle; and securing the nozzle lock to the engine casing.

2. A method in accordance with claim 1 wherein the nozzle lock includes a locking pin and a base, said step of inserting a nozzle lock further comprises the steps of:

inserting the locking pin through the first opening; and retaining the nozzle lock base radially outward of the exterior surface.

3. A method in accordance with claim 2 wherein said step of coupling the nozzle lock further comprises the step of securing the locking pin to the nozzle to restrict movement of the nozzle.

4. A method in accordance with claim 2 wherein the nozzle lock includes an attachment device coupled to the base, said step of securing the nozzle lock further comprises the steps of:

forming a second opening in the casing exterior surface; and coupling the attachment device to the engine casing through the second opening.

5. A method in accordance with claim 2 wherein the nozzle lock includes a seal extending around the locking pin, said step of securing the nozzle lock further comprises the step of sealing the first opening with the seal.

6. A nozzle lock for a gas turbine casing including a nozzle, said nozzle lock comprising:

a base;

an attachment device coupled to said base; and at least one locking pin extending from said base and configured to extend through an opening defined in the turbine casing to secure the nozzle, wherein the turbine casing opening is offset from a direction of load application induced to said at least one locking pin during engine operation.

7. A nozzle lock in accordance with claim 6 wherein said at least one locking pin is formed unitarily with said base.

8. A nozzle lock in accordance with claim 6 wherein said base comprises an aperture, said locking pin secured in said aperture.

9. A nozzle lock in accordance with claim 6 wherein said attachment device includes a rivet.

10. A nozzle lock in accordance with claim 6 wherein said attachment device includes a bolt.

11. A nozzle lock in accordance with claim 6 further comprising at least one seal, each said at least one locking pin configured to extend through at least one seal.

12. A nozzle lock in accordance with claim 11 wherein said at least one seal comprises a metallic O-ring seal.

13. A gas turbine engine comprising:

a casing comprising an exterior surface comprising at least one opening extending therethrough;

a gas turbine engine nozzle; and at least one nozzle lock mounted to said exterior surface for securing said nozzle to said casing, each said at least one nozzle lock comprising a locking pin extending through one of said at least one opening engaging said nozzle, said at least one opening offset from a direction of load application applied to said at least one nozzle lock during engine operation.

14. A gas turbine engine in accordance with claim 13 wherein said nozzle lock further comprises an attachment device configured to secure said nozzle lock to said casing exterior surface.

15. A gas turbine engine in accordance with claim 14 wherein said attachment device comprises a bolt.

16. A gas turbine engine in accordance with claim 14 wherein said attachment device comprises a rivet.

17. A gas turbine engine in accordance with claim 13 wherein said nozzle lock further comprises a seal in sealing contact between said nozzle lock and said casing exterior surface.

18. A gas turbine engine in accordance with claim 13 wherein said nozzle comprises a slot, said locking pin configured to engage said nozzle within said slot.

19. A gas turbine engine in accordance with claim 13 wherein said nozzle lock further comprises a base, said locking pin unitary with said base.

20. A gas turbine engine in accordance with claim 13 wherein said nozzle lock further comprises a base, said base comprising an aperture, said aperture receiving said locking pin.

* * * * *